US008117784B2

(12) United States Patent
Tarrega Illoret

(10) Patent No.: US 8,117,784 B2
(45) Date of Patent: Feb. 21, 2012

(54) MECHANISM FOR A SLIDING GLASS PANE

(75) Inventor: Miguel Angel Tarrega Illoret, Barcelona (ES)

(73) Assignee: Klein Iberica, S.A., Barcelona (ES)

( * ) Notice: Subject to any disclaimer, the term of this patent is extended or adjusted under 35 U.S.C. 154(b) by 326 days.

(21) Appl. No.: 11/443,867

(22) Filed: May 31, 2006

(65) Prior Publication Data

US 2007/0062121 A1 Mar. 22, 2007

(30) Foreign Application Priority Data

Sep. 16, 2005 (ES) ..... 200502261

(51) Int. Cl.
*E05D 13/00* (2006.01)

(52) U.S. Cl. ..... 49/425; 49/409; 16/91; 16/97; 16/106

(58) Field of Classification Search ..... 49/409, 49/410, 425; 4/557, 607, 610; 16/105, 91, 16/97, 99, 102, 106, 107
See application file for complete search history.

(56) References Cited

U.S. PATENT DOCUMENTS

| | | | | | |
|---|---|---|---|---|---|
| 558,474 | A * | 4/1896 | Bierbach | 49/410 |
| 1,610,282 | A * | 12/1926 | Hansen | 49/410 |
| 5,450,693 | A * | 9/1995 | Tarrega | 49/411 |
| 5,791,089 | A * | 8/1998 | Prevot et al. | 49/425 |
| 5,950,279 | A * | 9/1999 | Chaput | 16/105 |
| 6,148,451 | A * | 11/2000 | DeBraal et al. | 4/607 |
| 2006/0191101 | A1 * | 8/2006 | Elmer | 16/91 |

FOREIGN PATENT DOCUMENTS

ES 2084543 5/1996

* cited by examiner

*Primary Examiner* — Jerry Redman
(74) *Attorney, Agent, or Firm* — Merchant & Gould P.C.

(57) ABSTRACT

The present invention relates to a mechanism for a sliding-type glass pane, of those formed by a top guide profile, placed against the wall and provided with a rib on which a rolling element moves; a bottom guide; a suspension device and top retaining stops, in which the suspension device has a larger outer plate and two smaller inner plates, which define a space between them in which the rolling element is housed and in which the top retaining stops are provided with respective horizontal flats so as to retain the cylinders.

1 Claim, 3 Drawing Sheets

MECHANISM FOR A SLIDING GLASS PANE

OBJECT OF THE INVENTION

The present invention relates to a mechanism for a sliding-type glass pane.

BACKGROUND OF THE INVENTION

Spanish patent ES 2084543 is known among the sliding door assembly mechanisms, particularly aimed at glass pane doors. Said patent discloses a mechanism for sliding doors formed by a top rail, a bottom guide, suspension heads that can be fixed to the top edge of the door and means limiting door movement. Risks of breaking the glass pane due to handling and drilling and housing operations are prevented with the disclosed mechanism. With the aid of the figures attached to the description, it can be observed that there is a large separation between the wall on which the top rail is fixed and the glass door that is held by the suspension heads.

DESCRIPTION

In this sense, the present invention develops a mechanism for a sliding-type glass pane door for the purpose of providing minimum separation between the glass door and the wall. It is aimed at overcoming the aforementioned drawback by means of new features in the device holding the glass pane and in turn allowing the movement thereof between the top and bottom rails.

According to the invention, the mechanism is of the type that are formed by an inverted L-shaped top guide profile which is placed against the wall and provided with a rib of a considerably cylindrical profile; a bottom guide; a suspension device formed by plates that can be fixed together, which define a bottom grooving that can be coupled to the top portion of the pane; a rolling element that can move on the rib and top retaining stops.

It is characterized in a novel manner in that the suspension device comprises a larger outer plate, directly joined to which on its hidden face is the rolling element and two smaller inner plates, located one after the other and separated from one another, which define a space in which said rolling element is housed, said smaller inner plates being provided on their faces opposite to the larger side of the top profile with respective borings in which as many other retaining cylinders are housed, perpendicular to the direction of movement of the pane, and in that the top retaining stops are provided with respective horizontal flats, the free ends of which have a curved section so as to retain the cylinders.

The invention shall now be described, only by way of illustrative example, by means of the following examples that should by no means be considered to limit the scope of the invention.

DESCRIPTION OF AN EMBODIMENT

Figure 1:
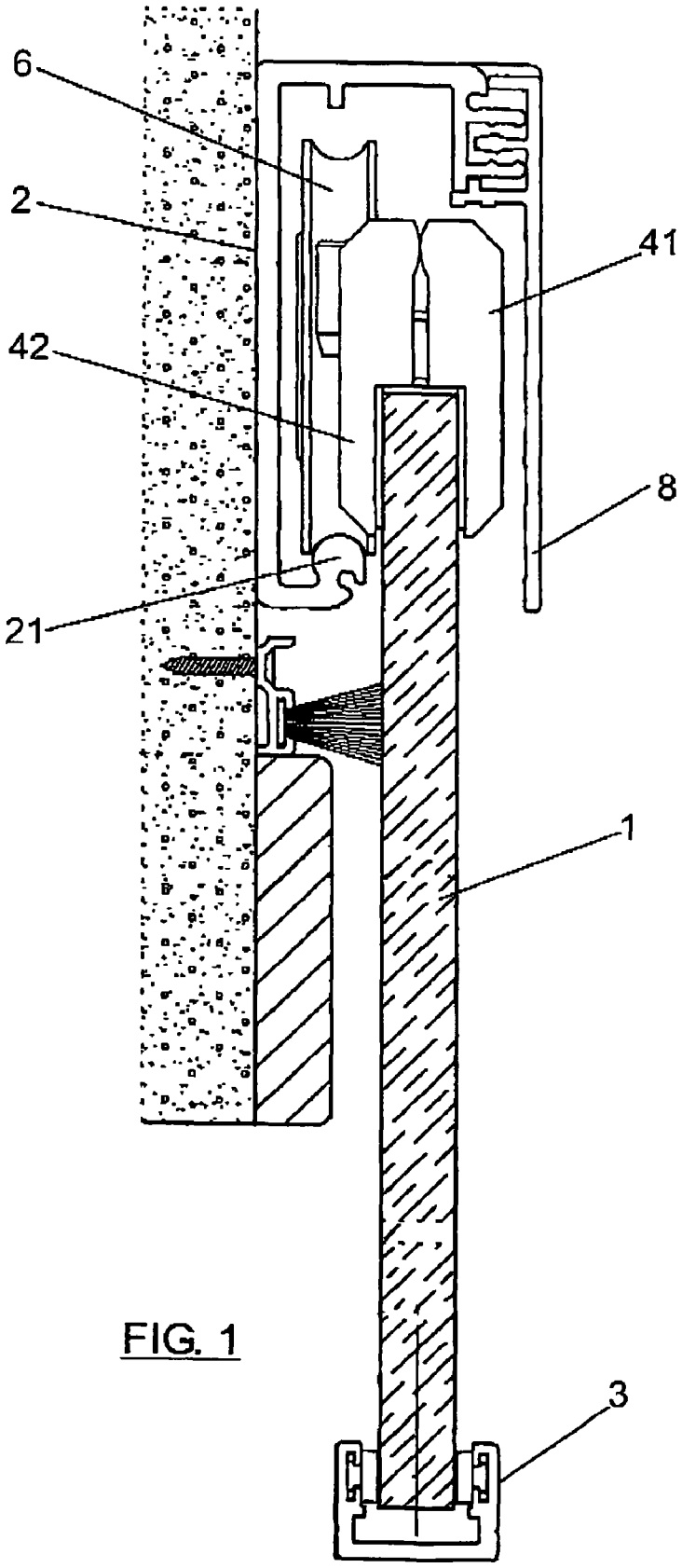
FIG. 1 shows a side view in which the elements forming the mechanism of the invention are shown.
Figure 2:
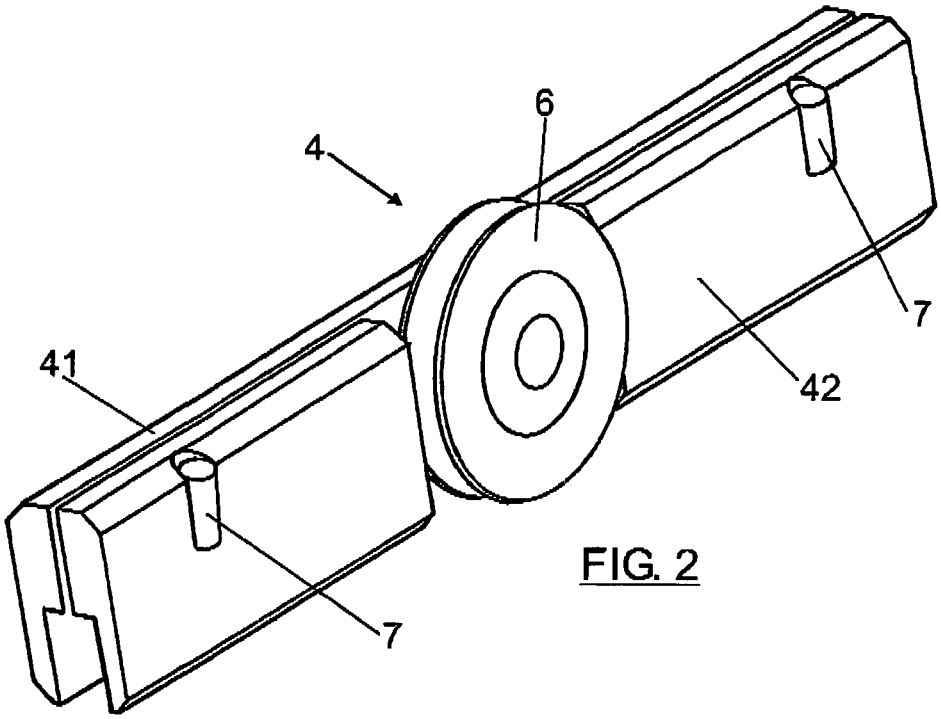
FIG. 2 shows a perspective view of the suspension device.
Figure 3:
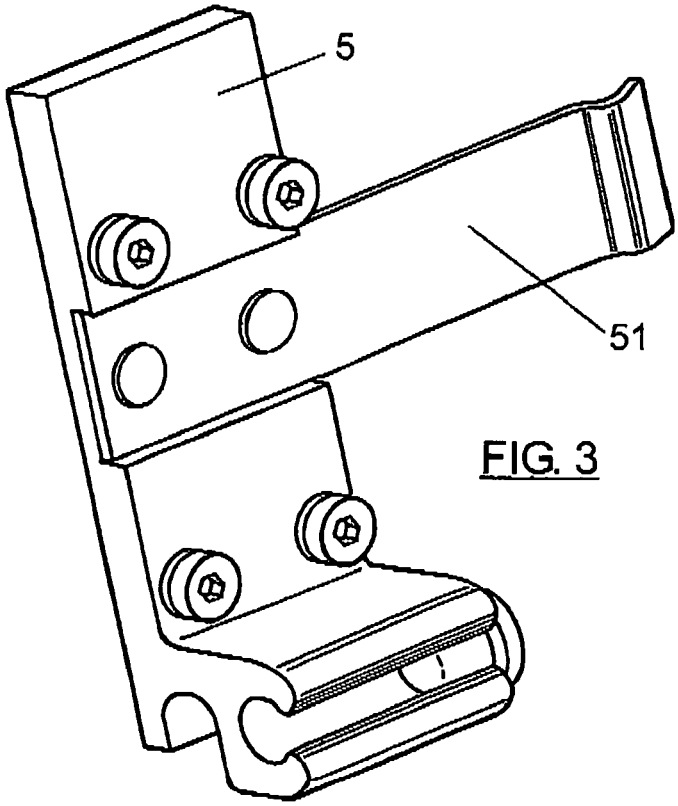
FIG. 3 shows a perspective view of one of the top retaining stops.
Figure 4:
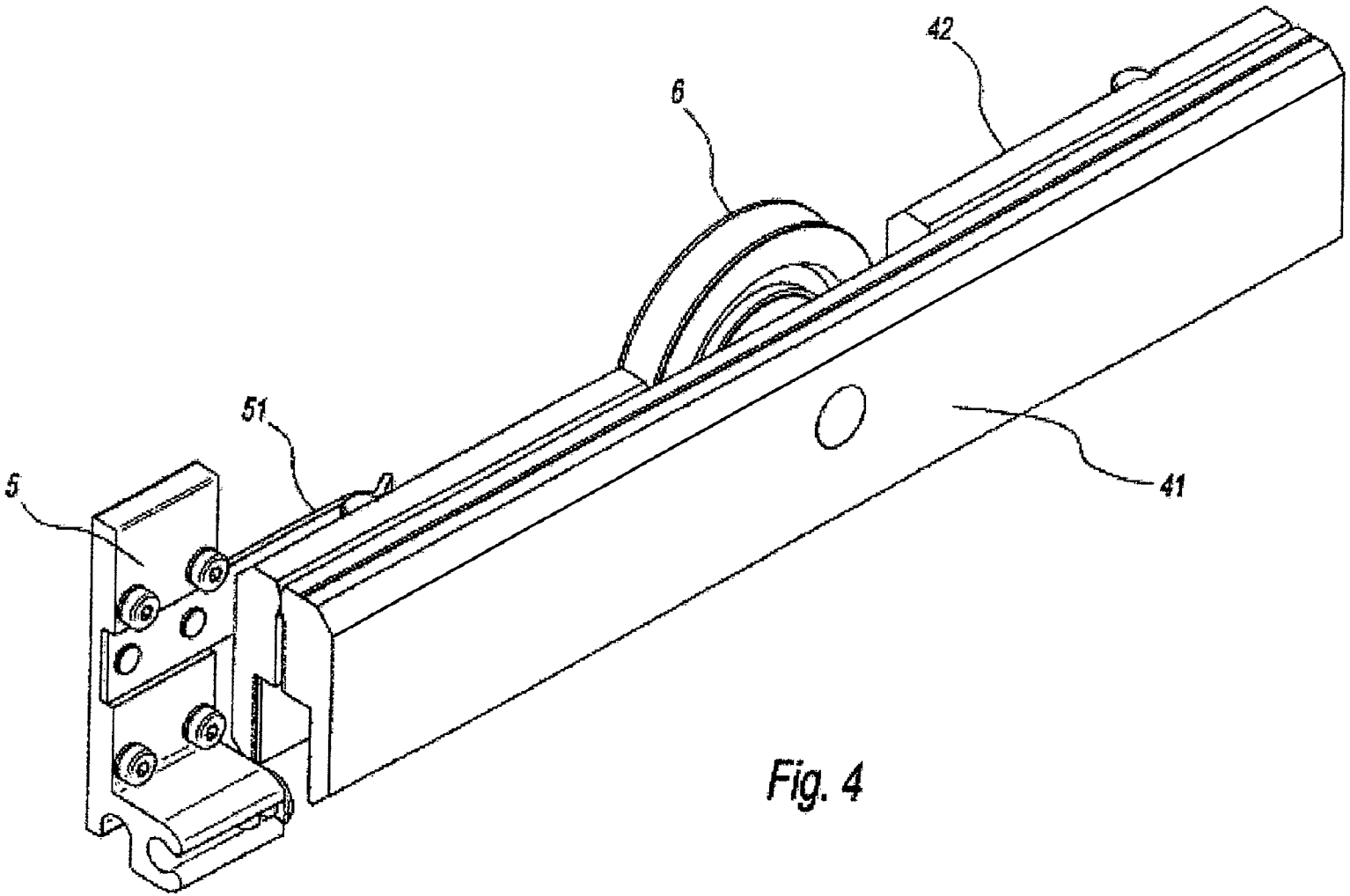
FIG. 4 shows a perspective view of the suspension device with retaining stop.

As can be seen in FIGS. 1 and 2, the mechanism for a sliding-type glass pane (1) is of the type formed by an inverted L-shaped top guide profile (2), which is placed against the wall, provided with a rib (21) of a considerably cylindrical profile on which a rolling element (6) can move; a bottom guide (3) which is parallel to said top profile, a suspension device (4) formed by plates that can be fixed together by means of a threaded connection, which define a bottom grooving in which the top portion of the pane are coupled and top retaining stops (5) on both sides of the movement of the pane (1).

The suspension device (4) comprises a larger outer plate (41), to which is directly joined through a rotating shaft on its hidden face, the rolling element (6) and two smaller inner plates (42).

The two smaller inner plates (42) are located one after the other and separated from one another for the purpose of defining a space in which the rolling element (6) is housed. The smaller inner plates (42) are provided on the surfaces that are opposite to the larger side of the top profile (21) with respective borings in which as many other retaining cylinders (7) are housed.

The cylinders (7) are located perpendicular to the direction in which the pane (1) moves.

Furthermore, the retaining stops (5) which are located in the top part of the mechanism consist of an aluminum profile with a vertical wall that is adjusted to the inner wall of the top guide profile (2). These stops (5) are provided with respective horizontal flats (51), the free ends of which respectively have a curved section so as to retain the cylinders (7).

The position of the stops can be locked by means of fixings incorporated to the vertical wall of the retaining stops (5).

The mechanism can be hidden through a pelmet profile (8) provided at the top portion, having three horizontal ribs, connected to the top guide profile. The connection is carried out through a plastic piece arranged intermittently along the C-shaped channel, pressing one profile against another.

The invention claimed is:

1. A mechanism having a suspension device for a sliding glass pane formed by an inverted L-shaped top guide profile which is placed against a wall provided with a rib for receiving a rolling element, a suspension device and a bottom guide for receiving a lower edge of the pane, said suspension device comprising:

only one outer larger plate including an inner surface and an outer surface;

two inner smaller plates fixedly joined and spaced apart from said inner larger surface to receive the pane therebetween;

a roller element movable on the rib and being affixed to said inner surface and disposed between said two inner plates; and two retaining stops including horizontal flats defining curved sections therein;

said two inner smaller plates including borings therein that receive retaining cylinders, said curved sections therein receiving retaining cylinders, wherein said retaining cylinders are located perpendicular to the direction in which the pane moves and to the axis of the rolling element.

* * * * *